United States Patent [19]

Manska

[11] Patent Number: 4,883,198

[45] Date of Patent: Nov. 28, 1989

[54] CONTAINER AND METHOD FOR DISPENSING SEMI-SOLID SUBSTANCES

[76] Inventor: Wayne E. Manska, 1921 Kellog Dr., Anaheim, Calif. 92807

[21] Appl. No.: 106,716

[22] Filed: Oct. 6, 1987

[51] Int. Cl.[4] ..... B67B 7/24

[52] U.S. Cl. ..... 222/1; 222/80; 222/481; 220/231; 220/277

[58] Field of Search ..... 222/80–81, 222/83, 152, 394, 398, 478, 481, 487, 491, 541; 220/231, 271, 265–280, 359; 206/603

[56] References Cited

U.S. PATENT DOCUMENTS

| | | | |
|---|---|---|---|
| 905,427 | 12/1908 | Heber et al. | 220/277 X |
| 957,013 | 5/1910 | Strater | 220/231 X |
| 2,799,437 | 7/1957 | Jepson | 222/481 |
| 3,289,880 | 12/1966 | Wilkich | 220/277 |
| 3,627,171 | 12/1971 | Kaplow et al. | 220/85 B |
| 3,856,184 | 12/1974 | Luviano | 222/80 |
| 3,856,187 | 12/1974 | Chlystun | 222/529 |
| 3,990,603 | 11/1976 | Brochman | 220/260 |
| 4,218,967 | 8/1980 | Batchelor | 99/472 |
| 4,319,697 | 3/1982 | De Barth | 222/80 |
| 4,356,935 | 11/1982 | Kamin | 222/1 |
| 4,513,884 | 4/1985 | Melzi et al. | 222/83 |
| 4,533,059 | 8/1985 | Kapolas et al. | 215/230 |
| 4,706,849 | 11/1987 | Ryan | 222/80 |

FOREIGN PATENT DOCUMENTS

| | | | |
|---|---|---|---|
| 110254 | 4/1940 | Austria | 220/44 |
| 428684 | 5/1935 | United Kingdom | 220/231 |

*Primary Examiner*—Michael S. Huppert

*Attorney, Agent, or Firm*—Knobbe, Martens, Olson & Bear

[57] ABSTRACT

A container for semi-solid substances includes a releasable seal adapted to be opened by a user. Opening of the seal releases vacuum pressure inside the container to allow the semi-solid substance to be dispensed from the open end of the container as a unitary mass.

8 Claims, 2 Drawing Sheets

CONTAINER AND METHOD FOR DISPENSING SEMI-SOLID SUBSTANCES

BACKGROUND OF THE INVENTION

The present invention relates to containers with semi-solid substances and to methods of dispensing semi-solid substances from containers.

Many semi-solid substances, particularly food products, are sold in disposable containers, such as cans. Examples include dog food, cream or condensed soups, frozen orange juice concentrate, and refried beans. These substances have a pasty or goopy consistency which makes it difficult to empty the contents of the container. Typically a utensil of some sort is needed to empty the container.

Accordingly, there is a need in the art for a container and method which permits such semi-solid substances to be readily dispensed from their containers.

SUMMARY OF THE INVENTION

The present invention comprises a container having first and second ends. The container is filled with a semi-solid substance, and the first end is removable to provide a mouth thereat for dispensing the semi-solid substance along an axis of flow. The axis extends from one end of the semi-solid substance to another end, and the mouth of the container has a cross-sectional area which is at least as large as that of other portions of the container to permit the semi-solid substance to slide out of the container. The cross-sectional areas are taken through sections perpendicular to the axis of flow.

The semi-solid substance is sufficiently viscous and cohesive to itself and to inner walls of the container to prevent air from readily flowing from the mouth to the second end, thereby in effect producing a vacuum retention force on the substance. The container additionally comprises a breakable seal at the second end, adjacent to the said another end of the axis of flow. The breakable seal, on release thereof, provides a vent area which allows air to enter between the second end and the semi-solid substance to break the vacuum retention force. The vent area is substantially smaller than the cross-sectional area of the mouth.

The invention also includes a method of dispensing contents from a container. This method comprises opening a top of the container to provide a mouth for dispensing a semi-solid substance which is sufficiently cohesive and viscous to prevent the contents from readily pouring from the mouth. The method also includes the step of opening a breakable seal formed on the bottom of the container to provide a vent for allowing air to flow into the container from the bottom. The container is then positioned with the mouth facing downwardly to dispense the semi-solid contents.

Another aspect of the invention includes a method of packaging utilizing a container having end surfaces and a breakable seal formed in one of the end surfaces. The method comprises introducing a product into the container such that the container is filled with a semi-solid substance.

DETAILED DESCRIPTION OF THE PREFERRED EMBODIMENT

Figure 1:
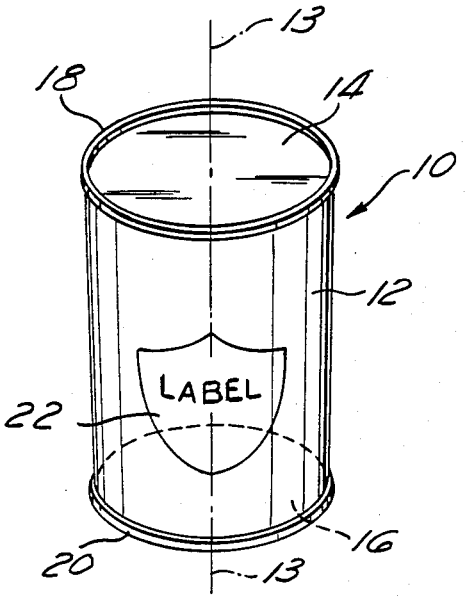
FIG. 1 is a perspective view of a preferred embodiment of the container of the present invention.
Figure 2:
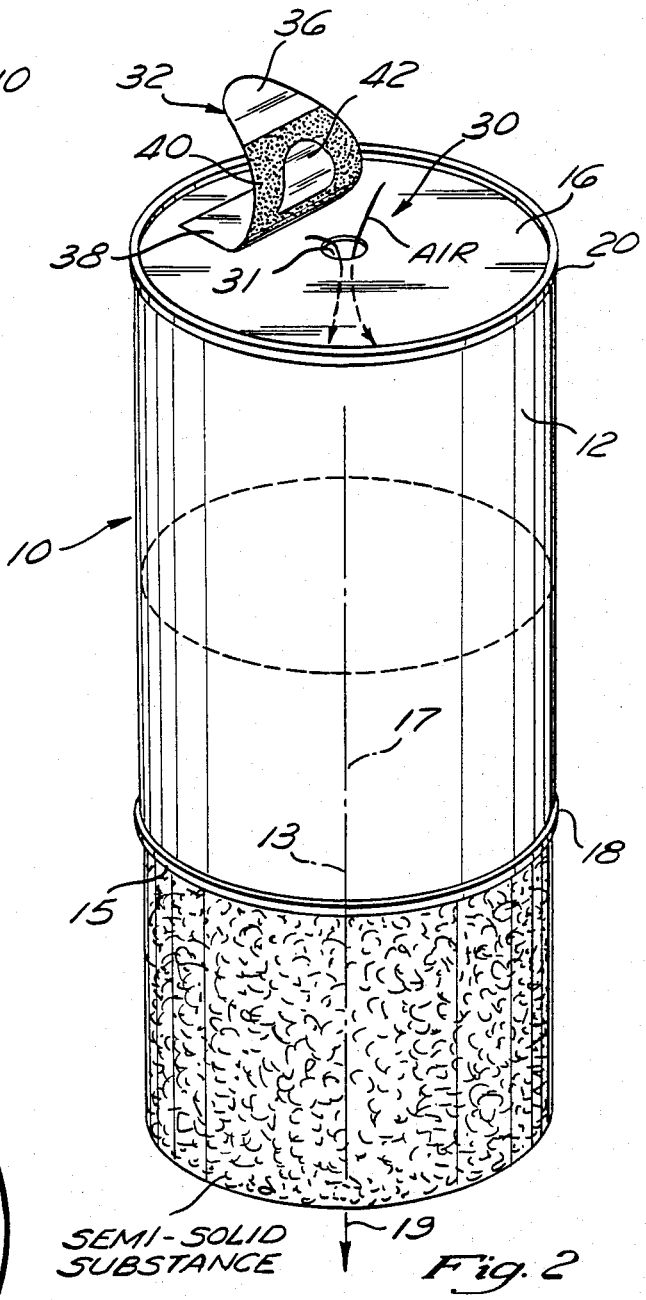
FIG. 2 is a perspective view of the container of FIG. 1 in an inverted position, showing the semi-solid substance being dispensed from the container after opening a releasable seal formed on the bottom of the container.

As shown in FIG. 1, the preferred embodiment of the present invention comprises a cylindrically-shaped, disposable container or can 10 having sides 12, and ends which form a top 14 and a bottom 16. The sides 12 provide a uniform cross section for the can 10. The can 10 has a longitudinal axis 13 which is parallel to the sides 12. Preferably, the sides 12 are perpendicular to the top 14 and bottom 16. Although the can 10 may be manufactured from a variety of rigid substances, including, heavy paper or cardboard, plastic, or metal, the particular can depicted is formed of metal and has a rim 18 at the juncture between the sides 12 and top 14 of the type commonly found on canned food products. The rim is adapted to permit the can 10 to be opened with an ordinary can opener so as to remove the top 14 and thereby provide an open mouth 15, as shown in FIG. 2, for dispensing the contents of the can along an axis of flow 17, which extends from one end of the substance to the other. This axis 17 is parallel to and coincident with the can axis 13 (FIG. 1), and the direction of movement 19 of the substance as it slides out of the mouth 15. In the preferred embodiment, the axes 13, 17 and direction 19 are parallel to the sides 12 and perpendicular to the top 14 and bottom 16.

In the embodiment shown, the bottom 16 of the can 10 includes a rim 20, similar to the rim 18. The top 14 and bottom 16 are sealed to the sides 12 to make the can 10 impermeable to air, and thereby seal the contents from the environment. Other types of openable tops may be used to permit opening without the need for a can opener. For example, the top 14 may be made with a tear string or plastic band seal, such as are commonly used on frozen juice concentrate containers, a foil "tear top" such as is commonly used on juice containers, a metal tear-off top of the type commonly used on sardine cans, or a metal band seal such as typically is found on cans of ham. Other examples include screw-off lids and pull-off lids. Further examples will be apparent to those skilled in the art.

Preferably, the can 10 includes a label 22 designating its contents, as shown in FIG. 1. The label 22 has a top and bottom and is oriented such that the bottom of the label is adjacent the bottom 16 of the can 10.

Although the container 10 of FIG. 1 is depicted as being cylindrical, other shapes such as a rectangular tube may be used. However, the dispensing end should be at least as large, cross-sectionally, as the remainder of the can for ease of dispensing.

The container 10 is filled with a semi-solid substance, which, in the embodiment illustrated, is dog food. As used herein, the term semi-solid substance means a substance having a viscosity which is sufficiently high to prevent the substance from readily pouring from the container. The semi-solid substance fills at least a substantial portion of the container, substantially covering and contacting the bottom 16 and contacting at least a substantial portion of the sides 12 between the top and the bottom such that air from the top cannot flow to the bottom except through the semi-solid substance. Further, the semi-solid substance is relatively cohesive and gluey, and free of voids, such that it is substantially impermeable to air thus preventing air from the top of the container from readily flowing through the substance or along the sides 12 of the can 10 to the bottom 16. Because air from the top 14 of the container cannot readily reach the bottom 16, any movement of the semi-solid substance out of the top of the can, will draw a vacuum at the bottom 16. This vacuum prevents the substance from easily dropping out of the container 10 when the container 10 is inverted. Assuming a can having a diameter of approximately three inches, and atmospheric pressure at about 15 pounds per square inch, there is about 100 pounds of vacuum force holding the semi-solid substance in the container. In contrast, the semi-solid contents of the container 10 may typically weigh, for example, no more than about a pound or so. It will thus be seen that the weight of the semi-solid substance is insufficient to overcome the vacuum force to permit the contents to readily flow out of the container of their own accord.

In order to release the vacuum which holds the semi-solid substance in the container 10, and thereby permit the substance to flow out of the container 10, the present invention includes a breakable seal 30. The seal 30 comprises a vent hole 31 on the bottom 16 at the center thereof and a peelable sealing strip 32, as shown in FIG. 2. In the embodiment depicted, the vent hole 31 is cleanly punched in the bottom surface 16, so that the edges of the hole 31 are flush with the surface and there are no metal spurs projecting into the can 10. The area of the hole 31 is substantially smaller than that of the top 14, bottom 16 and mouth 15. This vent hole 31 is covered by the peelable strip 32 which provides an airtight closure for the hole 31, and thus, maintains the contents in a septic, aseptic or sterile condition, as required for the particular substance. In the preferred embodiment, the peelable strip 32 is formed from a thin film material. These seals are well known in the art and are commonly used on fruit juice cans.

Figure 3:
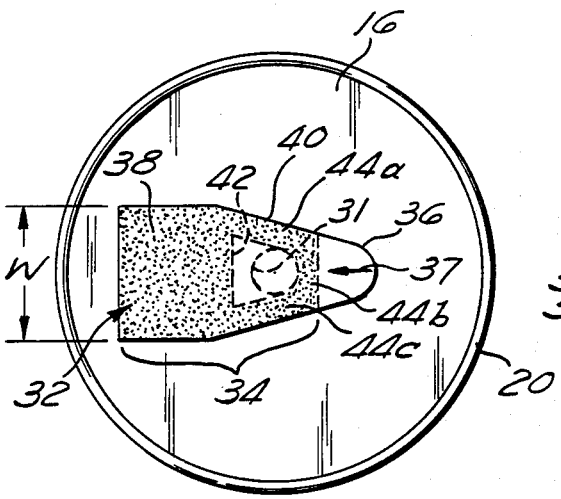
FIG. 3 is a plan view of a preferred embodiment of the releasable seal of the present invention.

The peelable strip 32 of the preferred embodiment is shown more clearly in FIG. 3, and includes a tongue portion 34 and a tab portion 36. The tongue portion 34 covers the vent hole 31 and has an adhesive on the underside thereof such that it adheres to the outer surface of the bottom 16 to seal the vent hole 31 from the atmosphere. The tab portion 36 has no adhesive and is sized to be grasped between the thumb and forefinger of a user. By pulling the tab portion 36 away from the surface 16, the tongue portion 34 is pulled back, thereby exposing the hole 31, and allowing air to enter therethrough and pass through the bottom 16 into the interior of the container 10. This process releases the vacuum pressure which holds the semi-solid substance in the can, and thereby permits the semi-solid substance to drop out of the can by its own weight when the can is inverted, as shown in FIG. 2. The contents of the can are thus dispensed cleanly as a unitary mass, such that substantially no product is left within the can. In the event that the contents of the container 10 are of a light weight nature, or have high adhesive bonding to the container walls, such that they do not have sufficient weight to drop out of the container of their own accord, the user may blow air through the vent hole 31 (e.g., by mouth) to create a positive pressure to force the contents to slide out of the container.

Referring to FIG. 3, the peelable strip 32 of the preferred embodiment is adapted for reclosure. With some food products, it is sometimes necessary to use the can as a measuring device for adding milk or water. For example, soups typically call for the addition of a can or half can of milk or water to the dispensed contents of the can. The hole 31 can be resealed by pressing the adhesive of the tongue portion 34 against the surface of the bottom 16, thereby permitting use of the container 10 for fluid measurement. Alternatively, the hole 31 may be resealed by means of a plug (not shown) or by placing the user's finger over the hole.

To ensure that the peelable strip 32 is not completely removed from the can 10 during the dispensing of the contents, the tongue portion 34 of the peelable strip 32 includes a stop portion 38 and a release portion 40. The release portion 40 includes an inner area 42 which has no adhesive on the underside thereof. This area 42 covers the hole 31, and may be somewhat larger than the hole 31. The non-adhesive area 42 is spaced from the marginal edges of the release portion 40, so as to provide marginal strip portions 44(*a*) to (*c*) which, with the stop portion 38, serve to surround the non-adhesive area 42, and thereby provide adhesive surfaces which completely seal the nonadhesive area 42 from the environment. The purpose of the nonadhesive area 42 is to reduce the amount of adhesive area in the release portion 40, and thereby make it relatively easy to peel back. The stop portion 38, on the other hand, is designed to provide high resistance to peeling by providing an adhesive area having a width w which is substantially greater than that of the release portion 40. Accordingly, when the release portion 40 is pulled back, the resistance to pulling will suddenly increase when the stop portion 38 is reached. This prevents or at least inhibits a user from completely peeling off the strip 32 from the container bottom 16, and thereby allows easy reclosure of the hole 31 by pressing the peeled-back release portion 40 onto the surface 16 to reseal the hole 31. The above-described differential resistance to pulling may also be accomplished by using a differential adhesive in which the sticking power of the adhesive on the stop portion 38 is greater than that of the release portion 40. As noted above, after resealing, the container can be filled with the desired amount of fluid, e.g., water or milk. Note that the water or milk can be dispensed through the hole 31, by releasing the seal a second time. Because the hole 31 is relatively small compared to the bottom 16, the water or milk will drain therethrough relatively slowly allowing controlled dispensing of the fluid, solvent or dilutant to the original dispensed contents.

Figure 4:
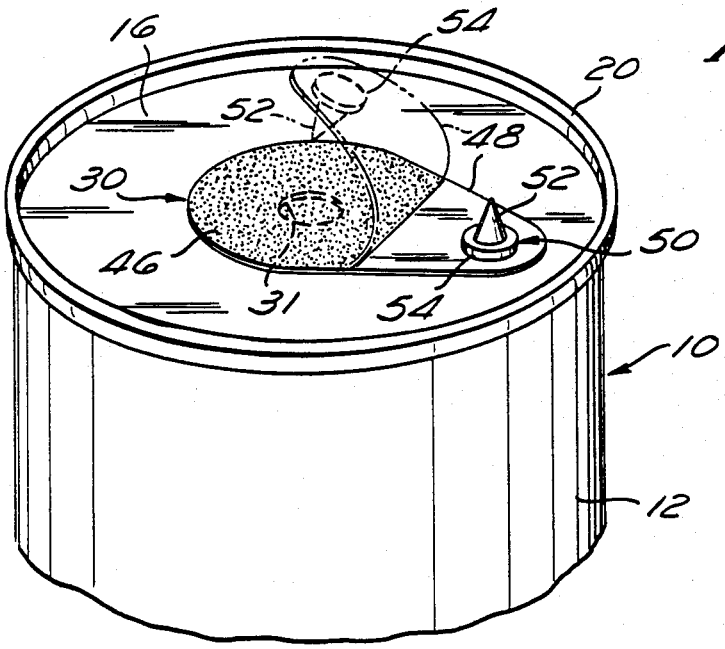
FIG. 4 is a partial perspective view of a seal having a spike and plug assembly.

In FIG. 4, a modified version of the breakable seal 30 of FIG. 2 is shown. The breakable seal 30 includes an adhesive portion 46 which covers the vent hole 31, and a tab portion 48. The adhesive portion 46 has an adhesive on the underside thereof, while the tab portion 48 has no adhesive on the underside thereof. Attached to the tab portion 48 is a spike and a plug assembly 50. The spike and plug assembly 50 comprises a conically-shaped spike 52 suitable for piercing a thin film material, and a plug 54 sized and shaped to fit snugly within the vent hole 31. In this embodiment, the tab portion 48 may be lifted away from the surface 16 and folded over the adhesive portion 46, such that the spike 52 pierces the adhesive portion 46 covering the vent hole 31. The spike 48 is then removed from the hole 31, thus allowing air to enter therethrough which, in turn, releases the vacuum pressure and permits the semi-solid substance to drop out of the can 10. The hole 31 in the bottom surface 16 can then be resealed by securely pressing the plug 54 into the hole 31.

Figure 5:
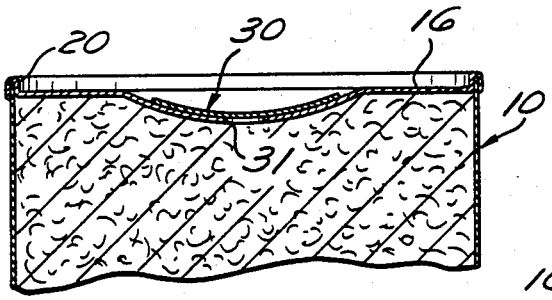
FIG. 5 is a partial elevation view, in cross-section of an alternative embodiment in which a normally convex bottom surface of the container is forced to assume a concave condition.
Figure 6:
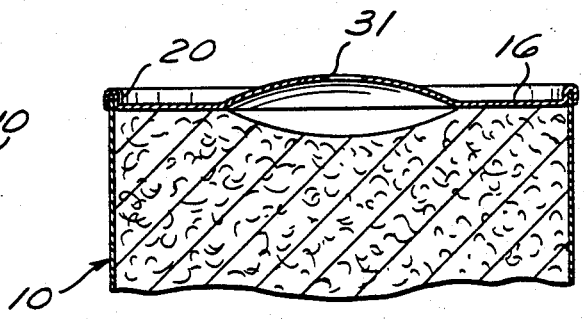
FIG. 6 is a partial elevation view, in cross-section of the bottom of the container of FIG. 5 upon release of the breakable seal, showing the bottom after it has sprung back into its original convex shape.

A modified container 10 is shown in FIG. 5. This container 10 may, for example, be used with the breakable seal 30 of either FIG. 3 or 4. This modified container is particularly suitable for use with semi-solid substances that are vacuum-packed during the canning process, and which have a residual vacuum in the container after canning is completed. In this embodiment, the bottom surface 16 of the container 10 has a generally convex curvature prior to being filled with the semi-solid substance. During the filling process, a force is applied to the bottom surface 16, such that the bottom surface 16 becomes concave, or at least less convex. This transformation of the surface 16 may be achieved by application of a mechanical force to the bottom of the can, or by application of a vacuum force during the canning process. Regardless of the manner in which the surface 16 is forced toward concavity, the container 10 is sealed with the surface 16 in a deformed condition, so that the surface 16 is retained in the deformed condition by residual vacuum retention forces within the container 10. When the breakable seal 30 is released, the bottom surface 16 springs back to its original convex shape, thus breaking the adhesion between the bottom 16 of the container 10 and the semi-solid substance, as shown in FIG. 6.

Although the preferred embodiment utilizes a peelable seal, those skilled in the art will recognize that other types of releasable seals 30 may be utilized alternatively, including, but not limited to, the various types of "pop top" openers used on soft drink and beer cans. Such pop top seals typically comprise a scored portion which preferentially breaks or tears along score lines, thereby providing an opening. A lever portion, commonly in the shape of a ring or tab, is attached to the scored portion such that, by lifting the lever portion, the user may break or tear the scored portion to provide the opening.

In the embodiments disclosed, the hole 31 is located near the center of the bottom 16. It is believed that a center location is more effective in releasing the vacuum pressure than a hole located near the periphery of the bottom 16. The center location permits the vacuum to be released more uniformly due to its equidistant location relative to the sides of the container 10. While a round hole has been illustrated in the drawings, other shapes may be utilized. For example, a star pattern having multiple rays radiating from its center may be desirable for some substances.

The present invention is appropriate for use with a wide variety of semi-solid substances. Examples include pasty substances, such as tomato paste, gelatinous substances, such as cream soups and cranberry sauce, wet solids, such as canned meats, frozen concentrates, such as juices, and other highly viscous substances such as refried beans and heavy consistency stews. These food products contain a mixture of moisture and solids which make them quite difficult to dispense from a can. The container of the present invention may also be used for highly viscous non-food items.

As discussed above, the present invention permits dispensing the semi-solid contents as a unitary mass. In some cases, however, it may be desirable to dispense only a portion of the contents (e.g., dog food). Advantageously, the vent hole 31 can be covered, for example, with a finger of the user, or by resealing the seal 30, to stop the flow of material out of the can and thereby limit the amount of product dispensed. Alternatively, the flow can be stopped by turning the can on its side. If necessary, the dispensed portion can be separated from the portion remaining in the can by manual force. For example, the dispensed end might be cut off with a knife or broken off by shaking the can or forcing it against a surface.

The walls of the can 10 may be coated with a lubricating substance, such as an oil or other non-stick substance prior to filling the can. Such coating inhibits adhesion of the contents to the walls of the can 10, and provides lubrication which allows the contents to easily slide out of the can. The use of lubricating coatings may be particularly advantageous for relatively lightweight substances and for substances which exhibit a high degree of adhesive bonding to the inner walls of the container.

I claim:

1. A container comprising first and second ends, and a side wall, said container being filled with a semi-solid substance, said first end being mechanically fastened to said side wall and being removable to provide a mouth for dispensing said semi-solid substance along an axis of flow, said axis extending from one end of said semi-solid substance to another end of said semi-solid substance, said mouth having a cross-sectional area which is at least as large as that of other portions of the container to permits said semi-solid substance to slide out of said container, said cross-sectional area being in a section perpendicular to said axis of flow, said semi-solid substance (a) being sufficiently viscous and cohesive to prevent air from readily flowing from said mouth to said second end, thereby producing a vacuum retention force on said substance, and (b) being sufficiently heavy and having sufficiently low adhesive bonding to said side wall such that after release of said vacuum retention force, said semi-solid substance will slide out of said container without the aid of a machine or device, said container additionally comprising a seal-breaking opening structure attached to said second end of said container, adjacent to said another end of said semi-solid substance, said seal-breaking opening structure comprising a peelable thin film covering a hole formed in said container at said second end, said seal-breaking opening structure being responsive to force applied thereto by a user to provide a vent area in said second end to release said vacuum retention force.

2. A container as defined by claim 1, wherein said peelable thin film has an adhesive backing and comprises a tab portion, a release portion and a stop portion, said release portion being more easily peelable than said stop portion.

3. A container as defined by claim 1, wherein said peelable film comprises a tab portion and an adhesive portion, said tab portion having a spike and plug assembly attached thereto.

4. A container as defined by claim 3, wherein said spike and plug assembly comprises a conically shaped spike for piercing said thin film, and a pug, sized and shaped to fit snugly into said hole.

5. A container, comprising first and second ends, and a side wall, said container being filled with a semi-solid substance, said first end being mechanically fastened to said side wall and being removable to provide a mouth for dispensing said semi-solid substance along an axis of flow, said axis extending from one end of said semi-solid substance to another end of said semi-solid substance, said mouth having a cross-sectional area which is at least as large as that of other portions of the container to permit said semi-solid substance to slide out of said container, said cross-sectional area being in a section perpendicular to said axis of flow, said semi-solid substance (a) being sufficiently viscous and cohesive to prevent air from readily flowing from said mouth to said second end, thereby producing a vacuum retention force on said substance, and (b) being sufficiently heavy and having sufficiently low adhesive bonding to said side wall such that after release of said vacuum retention force, said semi-solid substance will slide out of said container without the aid of a machine or device, said container additionally comprising a seal-breaking opening structure attached to said second end of said container, adjacent to said another end of said semi-solid substance, said seal-breaking opening structure being responsive to force applied thereto by a user to provide a vent area in said second end to release said vacuum retention force, said second end of said container being formed such that said second end springs away from said semi-solid substance when said vacuum is released, thereby breaking adhesion between said second end of said container and said semi-solid substance.

6. A method of dispensing contents from a container having a top which, when opened, forms a mouth for dispensing the contents, said container also having sides and a bottom, said contents being a semi-solid substance which is sufficiently cohesive and viscous to prevent said contents from readily pouring from said mouth, said method comprising:

opening said top to provide said mouth for dispensing said contents;

opening a seal-breaking opening structure formed on the bottom of said container to provide a vent for allowing air at atmospheric pressure to flow into said container from the bottom;

positioning said container with said mouth facing downwardly;

utilizing the weight of said substance to remove said substance from said container without increasing said pressure, such that the entire contents are dispensed from said container is a unitary mass;

sealing said vent after dispensing said contents; and adding fluid to said container and mixing said fluid with said dispensed contents.

7. A method of dispensing as defined by claim 6, additionally comprising the step of reopening said vent subsequent to said filling step and dispensing said fluid through said vent for mixing with said dispensed contents.

8. A method of dispensing as defined by claim 6, wherein the step of sealing the vent comprises placing a finger over said vent.

* * * * *